US010950210B1

(12) United States Patent
Lorence et al.

(10) Patent No.: US 10,950,210 B1
(45) Date of Patent: Mar. 16, 2021

(54) CYMBAL PERCUSSION APPARATUS

(71) Applicant: Ed Lorence, Gates Mills, OH (US)

(72) Inventors: William Lorence, Gates Mills, OH (US); Ed Lorence, Gates Mills, OH (US)

(73) Assignee: Ed Lorence, Gates Mills, OH (US)

( * ) Notice: Subject to any disclaimer, the term of this patent is extended or adjusted under 35 U.S.C. 154(b) by 0 days.

(21) Appl. No.: 16/668,930

(22) Filed: Oct. 30, 2019

(51) Int. Cl.
*G10D 13/065* (2020.01)
*G10G 5/00* (2006.01)

(52) U.S. Cl.
CPC ..... *G10D 13/065* (2013.01); *G10G 5/005* (2013.01)

(58) Field of Classification Search
CPC ..... G10D 13/065; G10G 5/005
See application file for complete search history.

(56) References Cited

U.S. PATENT DOCUMENTS 6,054,645 A 4/2000 Gauger
6,093,878 A * 7/2000 Hoshino ..... G10D 13/06 248/122.1
6,096,956 A * 8/2000 Hoshino ..... G10D 13/06 84/421
7,943,841 B2 5/2011 Toda
8,001,644 B1 8/2011 Martinez
8,198,522 B2 6/2012 Michael
8,288,639 B2 10/2012 Carraro
8,344,235 B2 1/2013 Steele
8,476,515 B2 7/2013 Coady
8,481,835 B1 7/2013 Liao
8,604,325 B2 12/2013 Sato
8,642,869 B2 2/2014 Prefontaine
8,692,098 B1 4/2014 Reinhard
8,710,342 B2 4/2014 Lin
8,723,014 B2 5/2014 Susami
8,785,758 B2 7/2014 Wissmuller
8,822,798 B1 9/2014 Martin
8,835,735 B1 9/2014 Lin
8,865,988 B2 10/2014 Nakata et al.
9,053,693 B1 6/2015 Wei
9,093,051 B2 7/2015 Sato et al.
9,093,052 B2 7/2015 Turpen
9,099,072 B2 8/2015 Yoshino
9,135,902 B2 9/2015 Yoshino
9,224,372 B1 12/2015 Spriggel
2006/0042451 A1* 3/2006 Marnell ..... G10D 13/065 84/422.3
2006/0243117 A1 11/2006 O'Donnell
2011/0056361 A1 3/2011 Steele
2011/0083543 A1 4/2011 Peterson
2011/0100195 A1 5/2011 Chen
2011/0107898 A1 5/2011 Coady
2011/0265633 A1 11/2011 Coady
2012/0097010 A1 4/2012 Michael
2012/0180617 A1 7/2012 Dorfman et al.
(Continued)

*Primary Examiner* — Kimberly R Lockett
(74) *Attorney, Agent, or Firm* — Mark E. Bandy; Rankin, Hill & Clark LLP

(57) ABSTRACT

A cymbal assembly having a pair of cymbals which are slidingly positionable relative to each other is described. The cymbals are typically maintained in contact with each other during play, and are actuatable by a foot pedal or other member. Additional versions of the cymbal assembly are described including the use of multiple cymbal pairs and adjustable tensioners between cymbals.

19 Claims, 8 Drawing Sheets

(56) References Cited

U.S. PATENT DOCUMENTS

| | | | |
|---|---|---|---|
| 2012/0210843 | A1 | 8/2012 | Sato |
| 2012/0255423 | A1 | 10/2012 | Saddler |
| 2012/0318119 | A1 | 12/2012 | Coady |
| 2013/0174711 | A1 | 7/2013 | Lin |
| 2013/0174712 | A1 | 7/2013 | Lin |
| 2013/0255471 | A1 | 10/2013 | Prefontaine |
| 2013/0291706 | A1 | 11/2013 | Van Dyk |
| 2014/0096664 | A1 | 4/2014 | Nakata et al. |
| 2014/0096665 | A1 | 4/2014 | Nakata et al. |
| 2014/0260896 | A1 | 9/2014 | Martin |
| 2014/0260897 | A1 | 9/2014 | Miyashita |
| 2014/0298972 | A1 | 10/2014 | Allen |
| 2015/0027296 | A1 | 1/2015 | Turpen |

* cited by examiner

CYMBAL PERCUSSION APPARATUS

FIELD

The present subject matter relates to a musical percussion cymbal apparatus.

BACKGROUND

Cymbals are used in a wide variety of ensembles and musical styles. Drum kits often include at least one cymbal or a pair of cymbals. Cymbals can be played using a single cymbal or in pairs. When played in pairs, cymbals are typically oriented horizontally toward each other and in a parallel, facing relationship. Such cymbal pairs are typically referred to in the art as a "high hat" (or "hi-hat") cymbal assembly. Although satisfactory in many respects, a need exists for another approach in playing cymbals which enables production of new and different sounds.

SUMMARY

Advances in musical instruments are addressed in the present subject matter as follows.

In one aspect, the present subject matter provides a cymbal assembly comprising a support stand defining a first end and a second opposite end. The cymbal assembly also comprises a selectively positionable actuation member disposed at a first end of the support stand. The cymbal assembly also comprises a displaceable member engaged with the actuation member and accessible at the second end of the support stand. And, the cymbal assembly additionally comprises a first cymbal affixed to the support stand, the first cymbal defining an inner cymbal face oriented along a first plane. The cymbal assembly also comprises a second cymbal affixed to the displaceable member and in contact with the first cymbal. The second cymbal defines an inner cymbal face oriented along a second plane, the second plane being parallel to the first plane. Upon positioning of the actuation member, the displaceable member and the second cymbal affixed thereto are displaced such that the second cymbal is slidingly displaced within the second plane along the first cymbal.

In another aspect, the present subject matter provides a cymbal assembly comprising a support stand having a base adapted for positioning on a floor and an upwardly extending longitudinal member. The cymbal assembly also comprises a foot pedal proximate the base of the support stand, the foot pedal positionable between (i) a neutral position, and (ii) an actuated position. The cymbal assembly also comprises a displaceable member generally extending along the support stand, the displaceable member being in communication with the foot pedal, the member undergoing movement upon a change in position of the foot pedal. The cymbal assembly also comprises a first cymbal affixed to the support stand, the first cymbal defining a first center axis and a transversely oriented first plane. And, the cymbal assembly additionally comprises a second cymbal affixed to the displaceable member, the second cymbal defining a second center axis and a transversely oriented second plane, the second cymbal being in contact with the first cymbal. Upon a change in position of the foot pedal between (i) the neutral position and (ii) the actuated position, the second cymbal undergoes movement relative to the first cymbal in a direction parallel with the second plane.

In still another aspect, the present subject matter provides methods of producing sounds using the cymbal assemblies of the present subject matter. The methods generally comprise providing a cymbal assembly including (i) a support stand, (ii) a selectively positionable actuation member, (iii) a displaceable member engaged with the actuation member, (iv) a first cymbal affixed to the support stand, and (v) a second cymbal affixed to the displaceable member and in contact with the first cymbal. The cymbal assembly is configured such that upon positioning of the actuation member, the displaceable member and the second cymbal affixed thereto are displaced and the second cymbal is displaced in a sliding manner relative to the first cymbal. The methods also comprise varying a position of the actuation member whereby the second cymbal is displaced relative to the first cymbal, thereby producing sound as a result of sliding contact between the first and second cymbals. As described in greater detail herein, sounds can also be produced by striking the cymbal(s) with an implement.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

The present subject matter relates to a unique musical percussion cymbal apparatus that creates a range of new sounds. The sounds are typically produced using slapping or sticking techniques. The slapping or sliding action is typically performed by actuation of a foot pedal. The sticking techniques can be manually performed. The cymbals are typically aligned vertically, and in certain embodiments tensioned or otherwise biased towards each other, so as to produce unique resonant sounds. During play, the cymbal surfaces slide across one another to create unique sound(s). The apparatus can be adjusted according to cymbal type, tensions, angles and other setups according to the percussionist style, taste, and/or desire. The apparatus can include multiple cymbal pairs or a single pair of cymbals configured in opposing, stacked, staggered arrangements; in combination with traditional high hat cymbal assemblies; and/or in combination with single cymbal(s).

Figure 1:
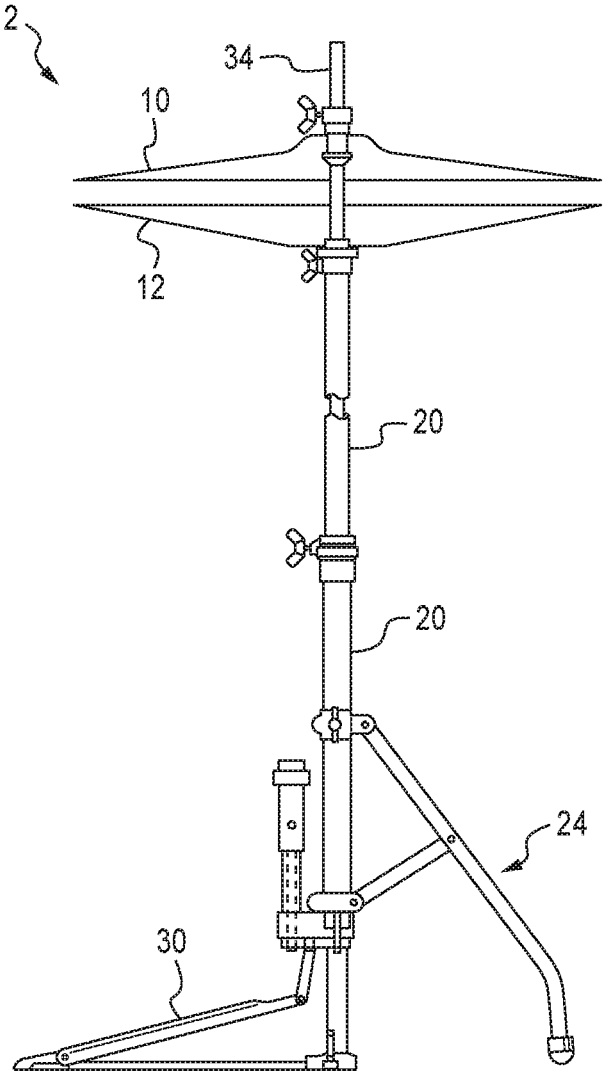
FIG. 1 (PRIOR ART)
FIG. 1 is an illustration of a prior art traditional high hat cymbal assembly.

FIG. 1 is an illustration of a traditional high hat cymbal assembly 2. The cymbal assembly 2 typically includes a top cymbal 10 and a lower cymbal 12. The cymbal assembly 2 also includes a stand 20 which may include one or more legs 24, and a foot pedal 30. The top cymbal 10 is secured to a moveable rod 34, and the lower cymbal 12 is secured to the stand 20. As will be understood, upon movement of the foot pedal 30, the rod 34 or other member is moved which thereby results in contact between the cymbals 10, 12.

Figure 3:
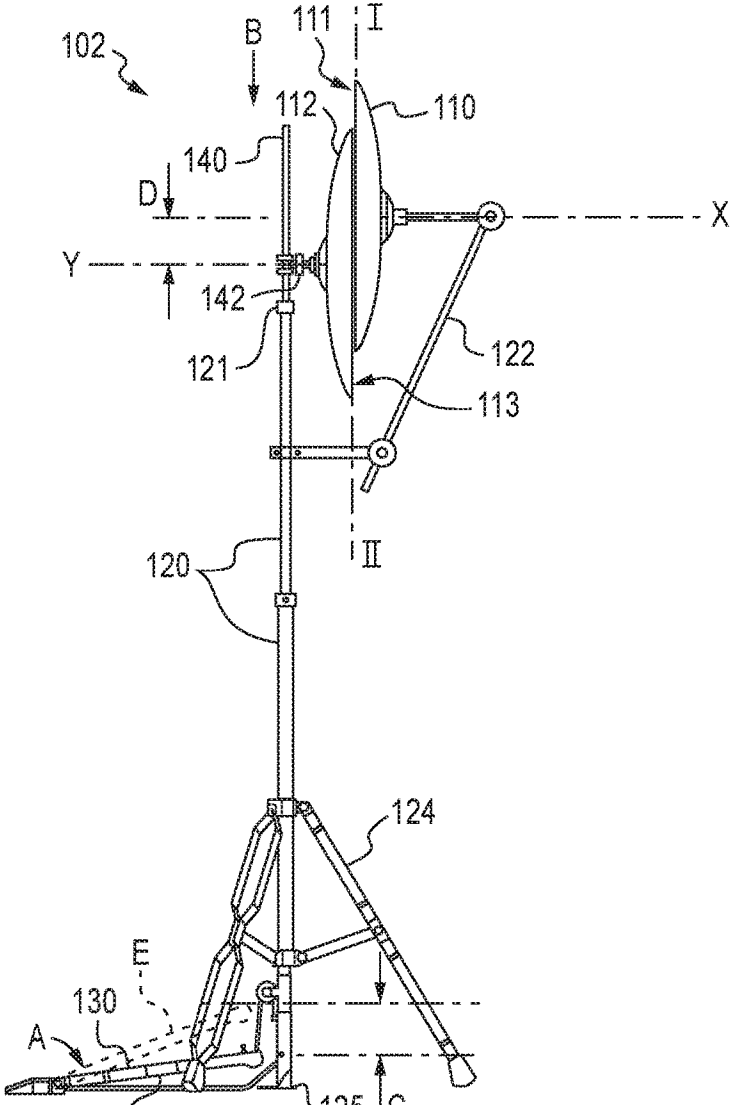
FIG. 3 is an illustration of the cymbal assembly of FIG. 2 in an open position.
Figure 2:
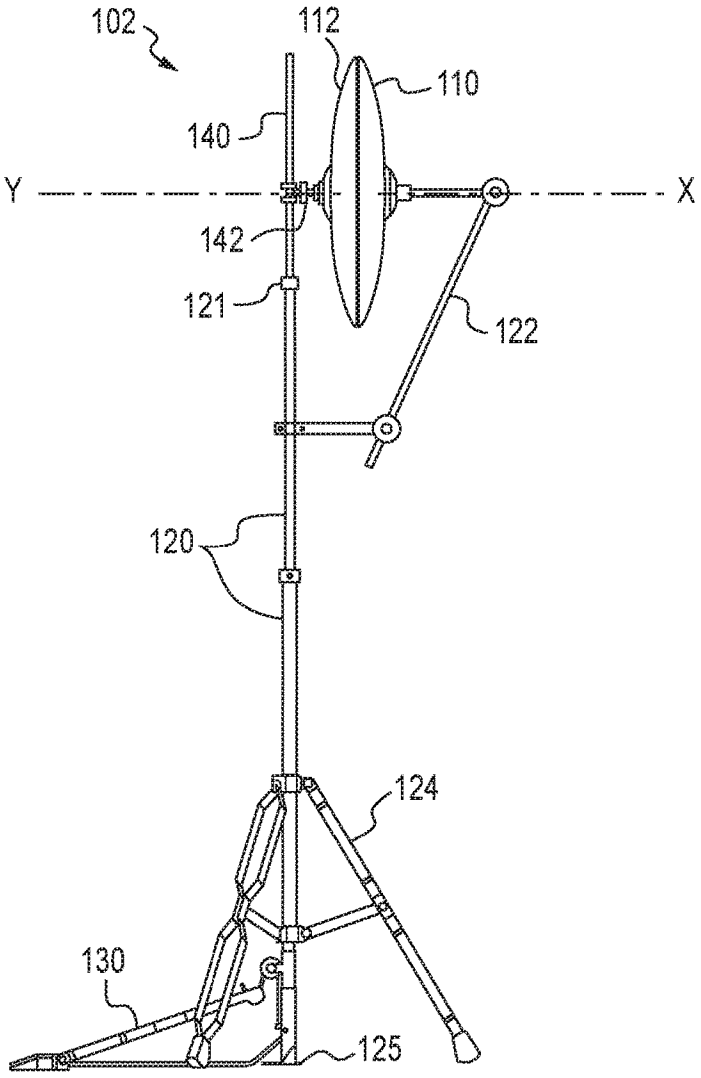
FIG. 2 is an illustration of an embodiment of a slide hat cymbal assembly in a neutral or closed position in accordance with the present subject matter.

FIGS. 2 and 3 illustrate an embodiment of a cymbal assembly 102 in accordance with the present subject matter. This cymbal configuration is referred to herein as a "slide hat" cymbal configuration. The cymbal assembly 102 comprises a first cymbal 110 defining an inner face 111, and a second cymbal 112 defining an inner face 113. Generally, each cymbal defines a center axis and an outer periphery or circumference that extends within a transversely oriented plane. The cymbals are typically oriented and aligned along a vertical plane as shown in the referenced figures. The cymbal assembly 102 also comprises a support stand 120 with one or more optional legs 124, a selectively positionable actuation member 130 which can for example be in the form of a foot pedal as shown, and a displaceable member 140 engaged with the actuation member 130. In many embodiments, the displaceable member 140 is sized to be movably positionable within a conduit or hollow interior of the stand 120. One or more bearings or low friction coatings can be used to support and govern movement of the member 140. The stand 120 defines a first end 125, typically adjacent to or in contact with a floor or stage, and a second end 121. The first cymbal 110 is affixed to the stand 120, typically by an attachment assembly 122. The second cymbal 112 is affixed to the displaceable member 140, typically by an attachment assembly 142.

As will be appreciated, the actuation member or foot pedal 130 is positionable between (i) a neutral position such as shown in FIG. 2 in which typically the first cymbal 110 and the second cymbal 112 are concentrically aligned with each other; and (ii) an actuated position such as shown in FIG. 3 at which typically the first cymbal 110 and the second cymbal 112 are offset from one another. The term "offset" as used herein refers to a center axis X of the first cymbal 110 being spaced from a center axis Y of the second cymbal 112 as shown in FIG. 3. The cymbals 110, 112 are offset from each other by an offset distance D. In many instances, upon the cymbals 110 and 112 being offset from one another, their corresponding center axes X and Y are parallel with each other. During cymbal play, the cymbals 110, 112 are typically in contact with each other and their respective transversely oriented planes are parallel with one another. In many embodiments, upon positioning the foot pedal to the neutral position, the center axis of the first cymbal is collinear with the center axis of the second cymbal. In many embodiments, during cymbal play, the respective center axes of the cymbals 110, 112 are moved relative to each other yet typically remain parallel to each other. However, the present subject matter includes embodiments in which during cymbal play, the respective center axes of the cymbals 110, 112 are moved relative to each other yet are not parallel to each other and instead are oriented at an angle with respect to each other.

Upon movement or actuation of the foot pedal 130, such as by movement in the direction of arrow A depicted in FIG. 3, the displaceable member 140 is moved in the direction of arrow B. As a result of such movement, the second cymbal 112, affixed to the member 140 via assembly 142 is also moved in the direction of arrow B. Depending upon the engagement provisions between the foot pedal 130 and the member 140, relative movement between the pedal and member can vary. However, for many versions, a change in distance C for the foot pedal 130 such as when moving the pedal 130 from position E to position F, results in a linear displacement corresponding to the offset distance D of the member 140 and cymbal 112 affixed thereto. Position E represents a neutral or "unpressed" position for the pedal. Position F represents an actuated or pressed position for the pedal. In such versions, the offset distance D is equal to distance C.

Figure 4:
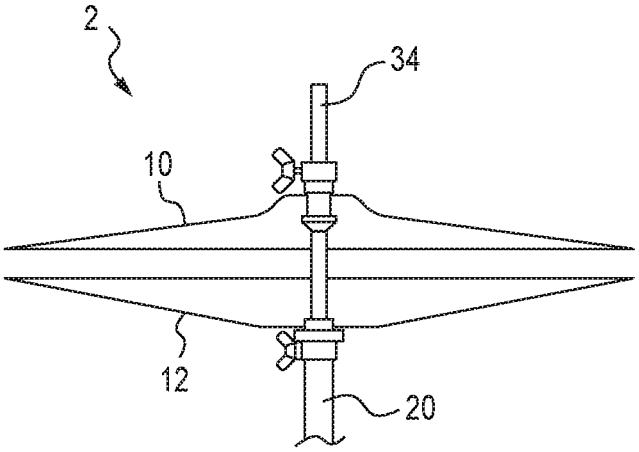
FIG. 4 (PRIOR ART)
FIG. 4 is a detailed view of cymbals in the traditional assembly of FIG. 1 in an open position.
Figure 6:
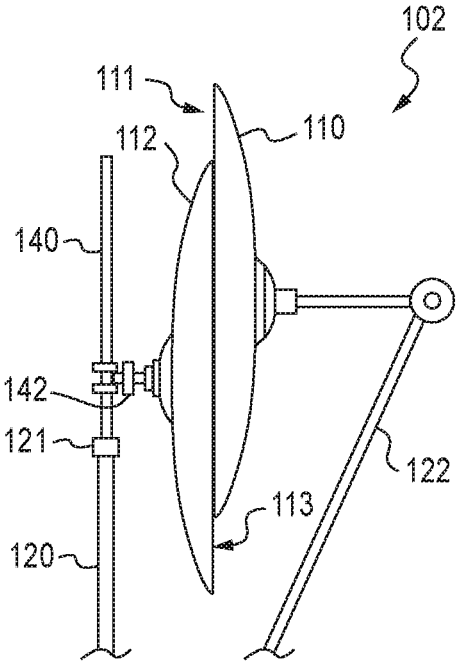
FIG. 6 is a detailed view of cymbals in the slide hat assembly of FIG. 2 in an open position.
Figure 5:
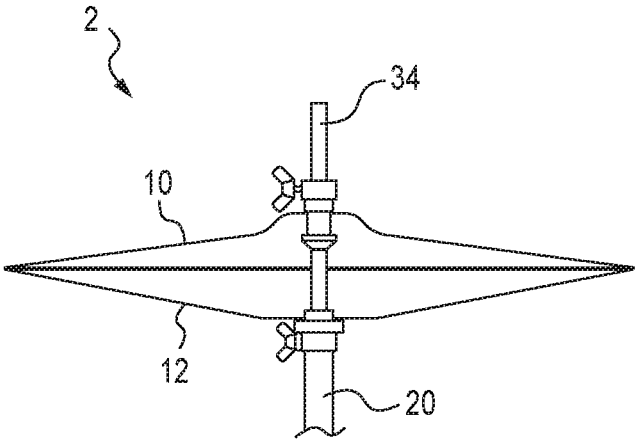
FIG. 5 (PRIOR ART)
FIG. 5 is a detailed view of cymbals in the traditional assembly of FIG. 1 in a closed position.
Figure 7:
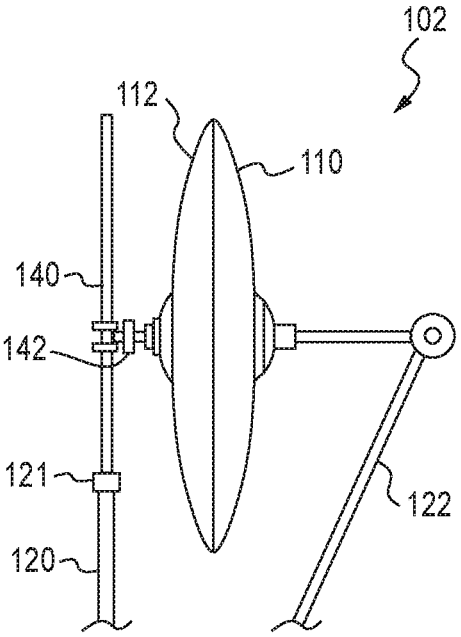
FIG. 7 is a detailed view of cymbals in the slide hat assembly of FIG. 2 in a closed position.

FIGS. 4-7 illustrate positions of cymbals 10, 12 in a traditional high hat assembly upon actuation of a foot pedal; and positions of cymbals 110, 112 in a slide hat assembly in accordance with the present subject matter. FIGS. 4 and 5 show the high hat assembly 2 in a neutral position and a closed position, respectively. FIGS. 6 and 7 show the slide hat assembly 102 in an open position and a closed position, respectively. In many versions, the cymbals 110, 112 are positioned to the open position depicted in FIG. 6 upon actuation of the foot pedal 130. However, it will be appreciated that the present subject matter includes a reverse cymbal configuration in which the cymbals 110, 112 are in a closed position as shown in FIG. 7 upon actuation of the foot pedal 130.

Figure 9:
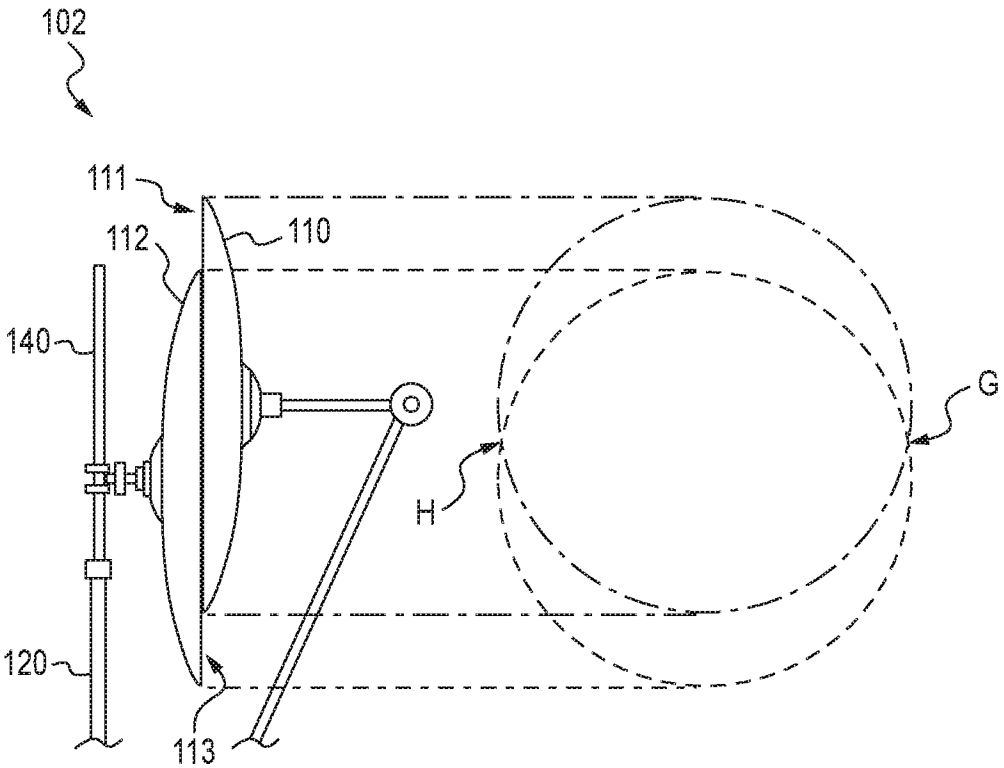
FIG. 9 is a schematic view of cymbals in the slide hat assembly of FIG. 2 in the open position showing multiple points of contact between the cymbals.
Figure 8:
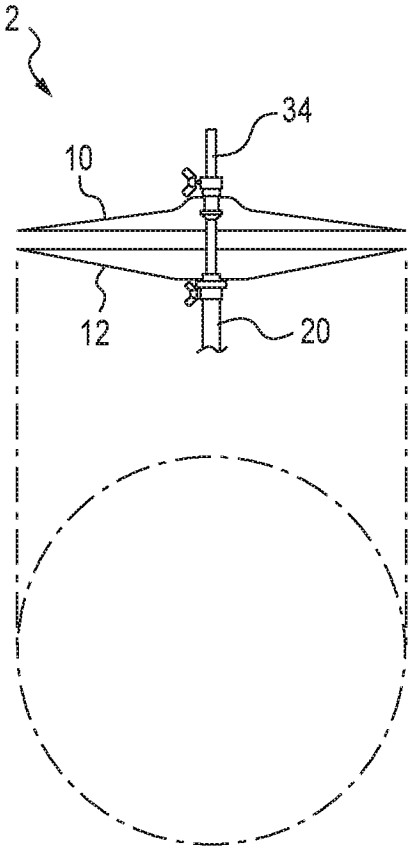
FIG. 8 (PRIOR ART)
FIG. 8 is a schematic view of cymbals in the traditional assembly of FIG. 1 in the open position showing no points of contact between the cymbals.

FIGS. 8 and 9 illustrate additional differences between the slide hat configuration of the assembly 102 in FIG. 9 as compared to the high hat configuration 2 shown in FIG. 8. Upon placing the cymbals 10, 12 of the assembly of FIG. 8 in an open position as shown, no contact occurs between the top cymbal 10 and the lower cymbal 12. Upon placing the cymbals 110, 112 of the assembly of FIG. 9 in an open position as shown, at least one point of contact occurs and in many embodiments two points of contact occur between the cymbals 110 and 112. These two points of contact are shown FIG. 9 as contact locations G and H.

During play of the slide hat cymbal configuration, the cymbal 112 is linearly displaced relative to the cymbal 110 in a sliding manner or "sliding contact" as referred to herein, typically while the cymbals 110, 112 are in contact with each other. That is, one cymbal is slidingly displaced relative to the other cymbal while the cymbals are oriented in a parallel facing relationship with one another. Thus, the points of contact between the cymbals, e.g., contact locations G and H move (i) along the periphery (or circumference) of a cymbal, and (ii) relative to each other such that the distance between the points of contact changes. These aspects, i.e., (i) and (ii), are believed to contribute to the new and unique sounds and ranges of sounds which can be produced using the slide hat configuration. Typically, a user can control the sound by the cymbal overlap, whereby different extents of closure result in different frequencies and resonance. It will be understood that a variety of different sounds can be produced by a user striking, slapping, brushing, "sticking", or otherwise contacting the cymbal(s) using implements such as drum sticks, brushes, or other members.

Figure 11:
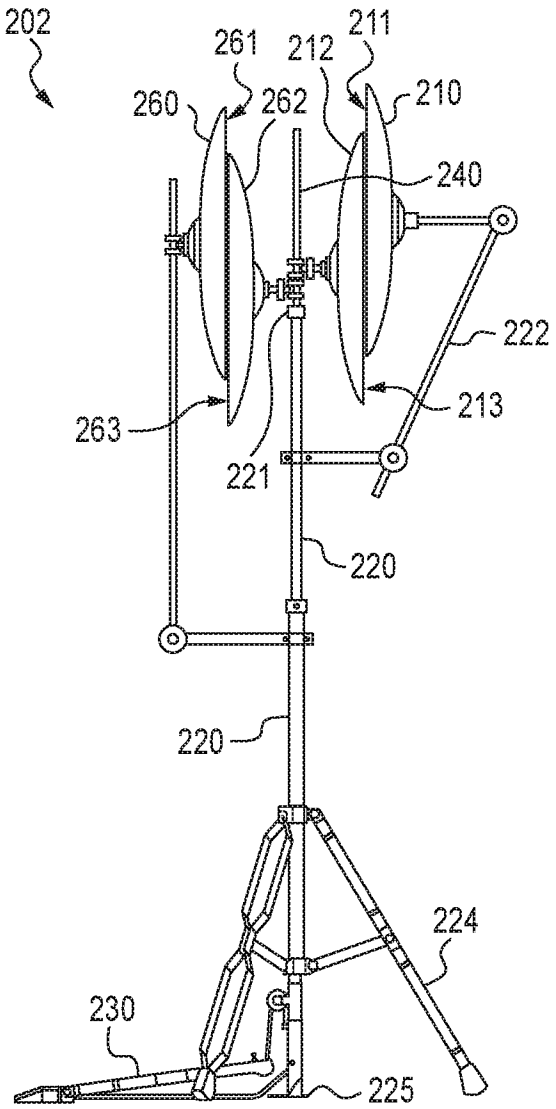
FIG. 11 is an illustration of the slide hat cymbal assembly of FIG. 10 in an open position.
Figure 10:
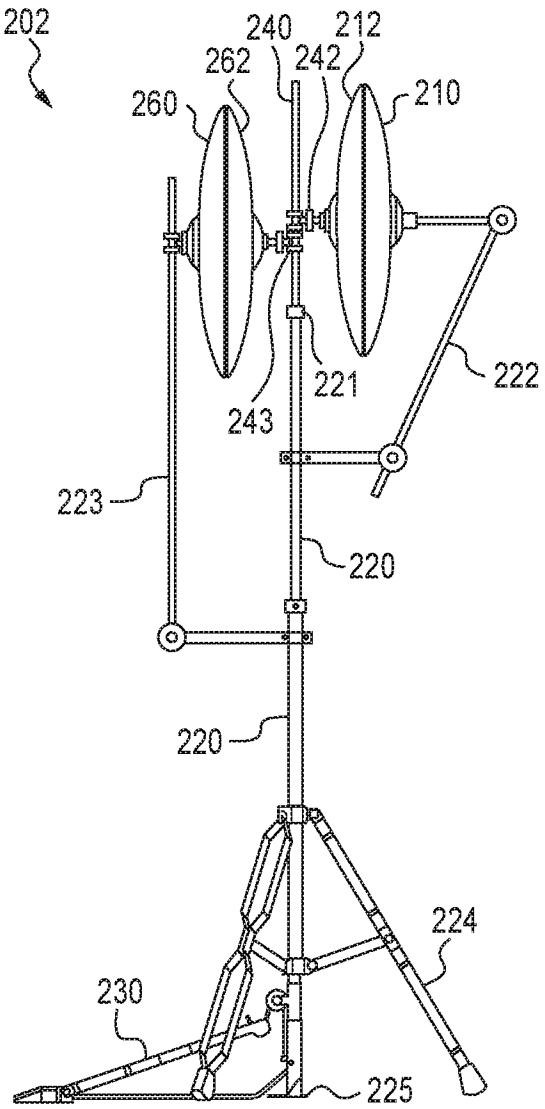
FIG. 10 is an illustration of another embodiment of a slide hat cymbal assembly in a closed or neutral position in accordance with the present subject matter.

FIGS. 10 and 11 illustrate another embodiment of a slide hat cymbal assembly 202 in accordance with the present subject matter. FIG. 10 shows the assembly in a closed position and FIG. 11 shows the assembly in an open position. The cymbal assembly 202 generally comprises a first pair (or "set") of cymbals including a first cymbal 210 defining an inner face 211, and a second cymbal 212 defining an inner face 213. The cymbal assembly 202 also comprises a second pair of cymbals including a third cymbal 260 defining an inner face 261 and a fourth cymbal 262 defining an inner face 263. Each pair of cymbals is typically oriented and aligned along a vertical plane. The cymbal assembly 202 also comprises a support stand 220 with one or more optional legs 224, a selectively positionable actuation member 230 which can be in the form of a foot pedal, and a displaceable member 240 engaged with the actuation member 230. The stand 220 defines a first end 225 and an opposite second end 221. The first cymbal 210 and the third cymbal 260 are affixed to the stand 220, typically by attachment assemblies 222 and 223, respectively. The second cymbal 212 and the fourth cymbal 262 are affixed to the displaceable member 240, typically by attachment assemblies 242, 243, respectively.

As previously described with respect to the slide hat cymbal assembly 102 of FIGS. 2, 3, 6, 7, and 9; upon actuation of the foot pedal 230, the displaceable member 240 is moved, typically in a direction coinciding with its longitudinal axis. As a result of such movement, the second cymbal 212, affixed to the member 240 by assembly 242; and the fourth cymbal 262, affixed to the member 240 by assembly 243 are also moved.

Figure 13:
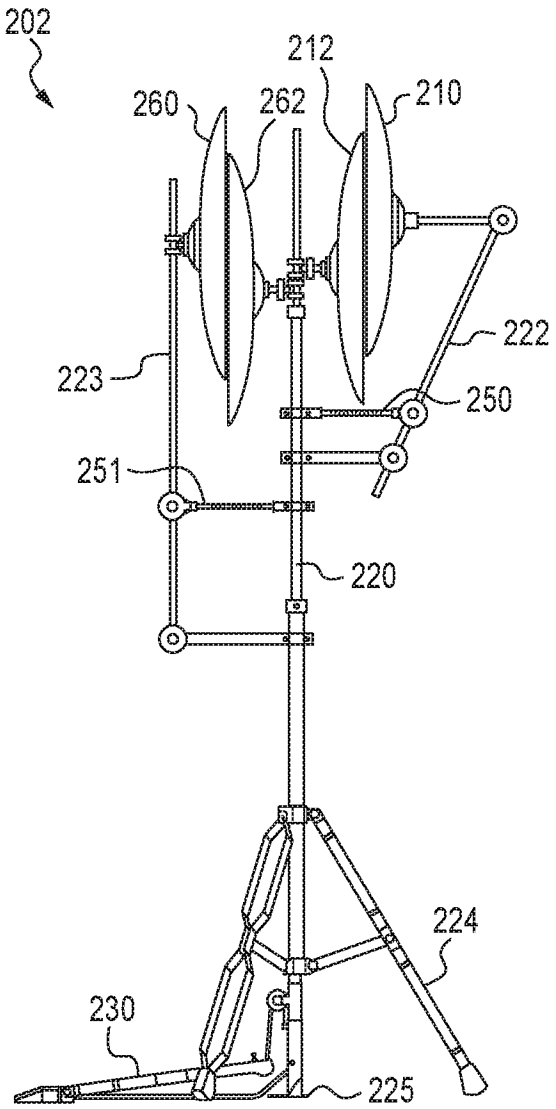
FIG. 13 is an illustration of the slide hat cymbal assembly of FIG. 11 including the biasing member(s).
Figure 12:
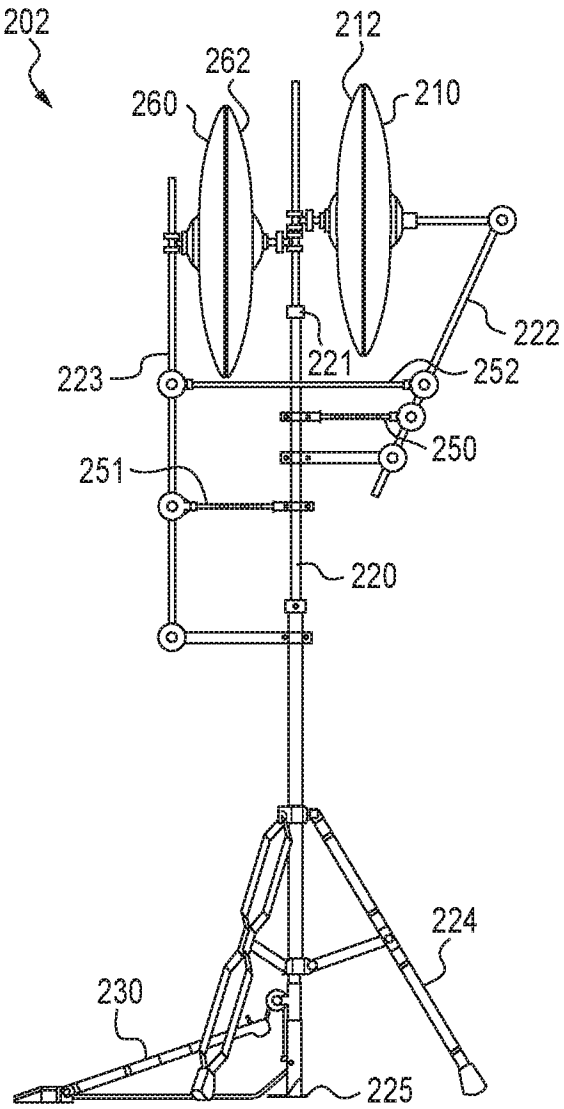
FIG. 12 is an illustration of the slide hat cymbal assembly of FIG. 10 including at least one biasing member.

FIGS. 12 and 13 illustrate the cymbal assembly 202 at a closed position and an open position, respectively. Although the figures depict the two pairs of cymbals opening and closing in unison, it will be understood that the present subject matter includes different arrangements and configurations. For example, the cymbal assembly 202 could be configured such that upon actuation of the foot pedal 230, the first pair of cymbals could change position from a closed position to an open position, and the second pair of cymbals could change position from an open position to a closed position. Other arrangements and modes of operation are contemplated and included in the present subject matter.

FIGS. 12 and 13 also schematically illustrate the use of one or more optional biasing members 250, 251, 252 in the slide hat cymbal assemblies. Specifically, a first biasing member 250 such as for example in the form of one or more tension spring(s) is provided in association with the attachment assembly 222 to promote contact between the first and second cymbals 210, 212. The biasing member 250 extends between the stand 220 and the assembly 222. And a second biasing member 251 such as for example in the form of one or more tension spring(s) is provided in association with the attachment assembly 223 to promote contact between the third and fourth cymbals 260, 262. The biasing member 251 extends between the stand 220 and the assembly 223. Use of biasing members 250 and 251 is an example of double biasing of the assembly. Instead of, or in addition to, the members 250, 251, a single biasing member 252 can be used which provides biasing between the members 222 and 223. For clarity purposes, the member 252 is not shown in FIG. 13. The present subject matter includes the use of different types and arrangements of biasing members. A wide array of components and/or assemblies can be used for the biasing member(s). A nonlimiting listing includes a wide variety of springs, elastomeric members, rubber straps, mechanical slides, pneumatic provisions, hydraulic cylinders, . . . etc. And, the present subject matter includes the use of one or more biasing members which can for example be in the form of tensioners used in association with the slide hat cymbal assembly 202 described herein.

Figure 15:
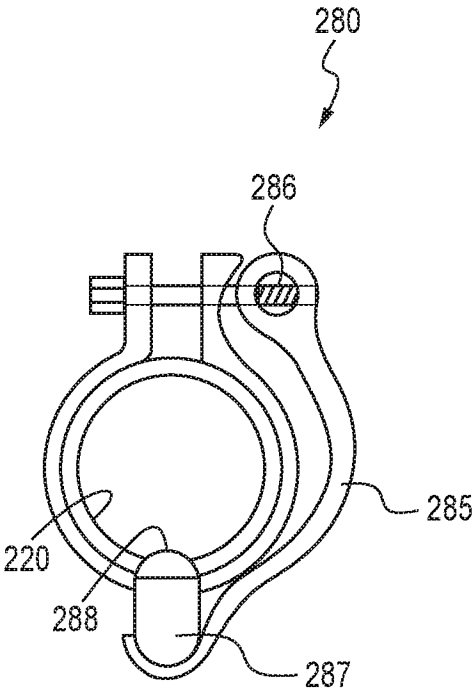
FIG. 15 is an illustration of the arm assembly of FIG. 14 in a use position.
Figure 14:
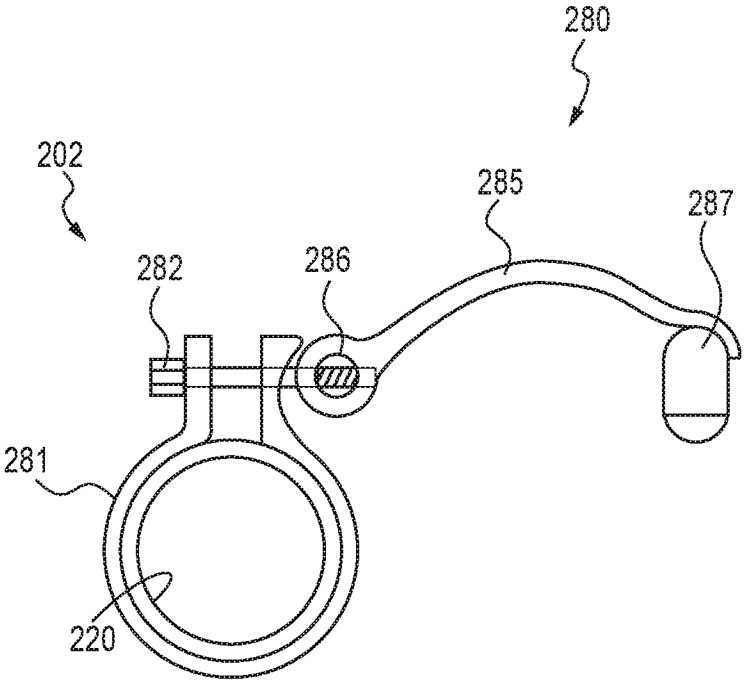
FIG. 14 is an illustration of an embodiment of an arm assembly that may be used with the slide hat cymbal assemblies of the present subject matter.
Figure 16:
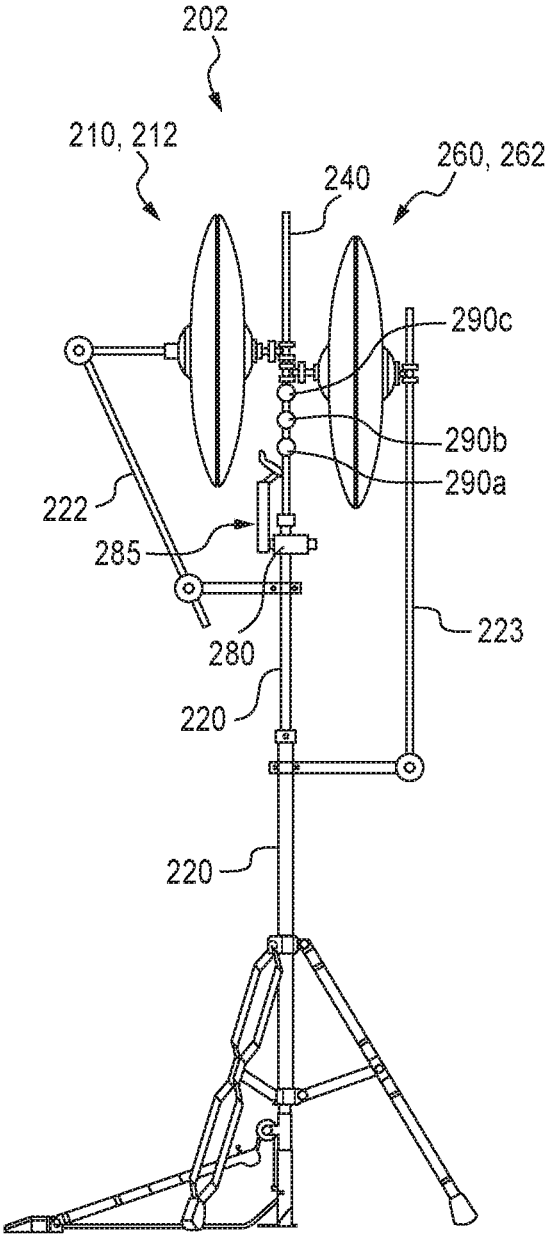
FIG. 16 is an illustration of a slide hat cymbal assembly utilizing the arm assembly of FIGS. 14 and 15 in combination with a plurality of cams.

FIGS. 14-16 illustrate embodiments of cam(s) 290 and an arm assembly 280 in accordance with the present subject matter. The cymbal assemblies may optionally include a cam and arm assembly to provide further variant sounds and percussion effects. The arm component is secured to a stationary portion of the stand, such as stand 220, and the cam component(s) is secured to a displaceable member, such as 240, on the stand. The arm and cam(s) are configured and/or positioned relative to each other such that upon movement of the displaceable member 240, contact occurs between the arm and cam(s) resulting in disruption of the movement of the displaceable member 240 and thus of the cymbal pair(s) 260, 262, 210, 212.

Specifically, FIGS. 14 and 15 illustrate the arm assembly 280 releasably secured to a stationary portion of the stand 220. The arm assembly 280 comprises a circumferential base member 281 sized and configured to extend at least partially around the stand 220. An adjustable tightening member 282 can be utilized to securely affix the assembly to the stand 220. A selectively positionable arm 285 extends from the base member 281 and includes a finger 287 which contacts the cam(s) 290 when the arm 285 is in a use position as shown in FIG. 15. The arm 285 can be positionally adjusted by a linkage 286. In many embodiments, the arm 285 is arcuate and more particularly, shaped to extend around a side or portion of the stand as shown in FIG. 15. Although a wide array of shapes and configurations may be used for the finger 287, in many versions the finger 287 includes a rounded face 288 which promotes sliding contact between the finger 287 and the cams 290.

FIG. 16 illustrates the arm assembly 280 and a plurality of cams 290*a*, 290*b*, and 290*c* in association with the previously described cymbal assembly 202. The cams 290*a*, 290*b*, and 290*c* are releasably affixed to the displaceable member 240 and are positioned at spaced intervals from each other along a length portion of the displaceable member 240. The cam(s) 290 may be in the form of a single cam member or a plurality of cam members and range in number from 1 to 5 or more. When utilizing multiple cams, each cam may have the same or different shape than other cam(s). A user may select the size(s), shape(s), spacing, and relative position of the cam(s) 290 to achieve a desired sound or effect. In the particular version depicted in FIG. 16, each cam 290*a*, 290*b*, and 290*c* is in the shape of a sphere or similar arcuate shape. Each of the cam(s) 290 is affixed to the displaceable member 240 by means known in the art such as by threaded engagement members for example. The cam(s) 290 attached to displaceable member 240, are removable to enable use of different cams.

FIG. 16 further illustrates the arm 285 extended to a use position wherein the finger 287 and/or face 288 contacts one or more of the cams 290*a*, 290*b*, and 290*c* as the foot pedal 230 is actuated causing axial movement of the displaceable member 240. The arm 285 is typically selectively positionable between a use position such as shown in FIG. 15, and an extended position such as shown in FIG. 14. In certain versions of the arm assembly 280, the arm 285 is configured to apply a compressive force against the outer surface of the displaceable member 240 and cam(s) 290 that the arm 285 may contact. Urging of the arm 285 in this manner further modifies the resulting sound and/or effect(s). Such can be accomplished by biasing the arm 285 using one or more biasing members such as springs or forming the arm from a resilient material. Selection of the contact force/pressure, arm style, arm shape, and configuration can be used to achieve desired sounds and/or effect(s). For example, it has been found that in order to promote separation of cymbals and no contact between cymbals, the use of a longer or "smoother" shaped cam and a cam shape that is less arcuate and which only slightly extends outward from the outer surface of the displaceable member 240; results in a separation of cymbals and no contact. When the pedal 230 is held in place such that the arm 285 is positioned on a flat portion of the cam 290, cymbal separation is maintained. This in turn allows a user to employ different sticking techniques that create different sounds.

It will be understood that the present subject matter includes a wide array of variations of the arm assembly 280 and cam(s) 290. In no way is the present subject matter limited to the particular versions shown in the referenced figures. Moreover, the arm assembly and cam(s) can be used with a variety of cymbal assemblies besides cymbal assemblies 102 and 202 shown in the referenced figures. Although the arm assembly 280 is described as secured to the stand 220 and the cam(s) 290 affixed to the displaceable member 240, it will be understood that the present subject matter includes alternative arrangements such as the arm assembly 280 affixed to the member 240 and the cam(s) affixed to the stand 220.

The various cymbal assemblies of the present subject matter, i.e., the slide hat cymbal assembly as generally referred to herein, can be played by nearly any technique including sticking or by using brushes or other implements to strike one or both of the cymbals of the cymbal pair. It will also be understood that the cymbals(s) can be struck with sticks, brushes, or other implements with the cymbals oriented at nearly any position. That is, the cymbals may be oriented along a plane that is vertical, horizontal, or at any inclination therebetween. Moreover, the cymbal(s) may be played or struck while the cymbals are at varying offset distances from each other, i.e., spacing distances between their center axes, while the cymbals are in contact with each other. As described in greater detail herein, the cymbals can be moved relative to one another such that the cymbals do not contact each other.

The present subject matter can utilize a wide array of cymbals and other components used in conventional cymbal assemblies such as for example those described in U.S. Pat. Nos. 6,054,645; 6,417,434; US 2006/0243117. A known high hat cymbal assembly is commercially available from Gibraltar under the designation Gibraltar 9707ML-UA Ultra Adjust Hi-Hat with Movable Leg Base.

It will be understood that the present subject matter can be used with a wide array of cymbals having circular and/or non-circular faces. For example, one or both cymbal faces of a cymbal set could exhibit non-circular shapes such as triangular, square, polygonal, octagonal, pentagonal, and/or irregular shape(s). in addition, the outer peripheral edge of cymbal(s) can be arcuate and/or non-arcuate. Nonlimiting examples of non-arcuate edges include a saw tooth edge, and a serrated edge for example. Commercially available cymbals can be obtained and then in accordance with the present subject matter utilized in the slide hat assemblies as described herein. Nonlimiting example of commercial sources for cymbals include Yamaha, Linear, Sabian, and Factory Metal Percussion.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter provides a new approach for creating new musical sounds. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A cymbal assembly comprising:

a support stand defining a first end and a second opposite end;

a selectively positionable actuation member disposed at a first end of the support stand;

a displaceable member engaged with the actuation member and accessible at the second end of the support stand;

a first cymbal affixed to the support stand, the first cymbal defining an inner cymbal face oriented along a first plane;

a second cymbal affixed to the displaceable member and in contact with the first cymbal, the second cymbal defining an inner cymbal face oriented along a second plane, the second plane being parallel to the first plane;

wherein upon positioning of the actuation member, the displaceable member and the second cymbal affixed thereto are displaced such that the second cymbal is slidingly displaced within the second plane along and in contact with the first cymbal.

2. The cymbal assembly of claim 1 wherein at least one of the inner cymbal face of the first cymbal and the inner cymbal face of the second cymbal is circular.

3. The cymbal assembly of claim 1 wherein at least one of the inner cymbal face of the first cymbal and the inner cymbal face of the second cymbal is non-circular.

4. The cymbal assembly of claim 1 wherein the first cymbal is in contact with the second cymbal at all positions of the actuation member.

5. The cymbal assembly of claim 4 wherein the first plane of the first cymbal and the second plane of the second cymbal are vertically oriented.

6. The cymbal assembly of claim 1 wherein the actuation member is positionable between (i) a neutral position at which the first cymbal and the second cymbal are concentrically aligned with each other, and (ii) an actuated position at which the first cymbal and the second cymbal are offset from each other.

7. A cymbal assembly comprising:

a support stand defining a first end and a second opposite end;

a selectively positionable actuation member disposed at a first end of the support stand;

a displaceable member engaged with the actuation member and accessible at the second end of the support stand;

a first cymbal affixed to the support stand, the first cymbal defining an inner cymbal face oriented along a first plane;

a second cymbal affixed to the displaceable member and in contact with the first cymbal, the second cymbal defining an inner cymbal face oriented along a second plane, the second plane being parallel to the first plane;

wherein upon positioning of the actuation member, the displaceable member and the second cymbal affixed thereto are displaced such that the second cymbal is slidingly displaced within the second plane along the first cymbal;

a third cymbal affixed to the support stand, the third cymbal defining an inner cymbal face oriented along a third plane;

a fourth cymbal affixed to the displaceable member, the fourth cymbal defining an inner cymbal face oriented along a fourth plane, the fourth plane being parallel to the third plane;

wherein upon positioning of the actuation member, the displaceable member, the second cymbal affixed thereto, and the fourth cymbal affixed thereto are displaced.

8. The cymbal assembly of claim 1 further comprising:

at least one biasing member urging at least one of the first cymbal and the second cymbal into contact with each other.

9. The cymbal assembly of claim 1 further comprising:

an arm assembly affixed to the stand, the arm assembly including an arm;

at least one cam affixed to the displaceable member;

wherein upon positioning of the actuation member, the arm contacts the at least one cam.

10. A cymbal assembly comprising:

a support stand having a base adapted for positioning on a floor and an upwardly extending longitudinal member;

a foot pedal proximate the base of the support stand, the foot pedal positionable between (i) a neutral position, and (ii) an actuated position;

a displaceable member generally extending along the support stand, the displaceable member being in communication with the foot pedal, the member undergoing movement upon a change in position of the foot pedal;

a first cymbal affixed to the support stand, the first cymbal defining a first center axis and a transversely oriented first plane;

a second cymbal affixed to the displaceable member, the second cymbal defining a second center axis and a transversely oriented second plane, the second cymbal being in contact with the first cymbal;

wherein upon a change in position of the foot pedal between (i) the neutral position and (ii) the actuated position, the second cymbal undergoes movement relative to the first cymbal in a direction parallel with the second plane and in contact with the first cymbal.

11. The cymbal assembly of claim 10 wherein during movement of the second cymbal, the first plane and the second plane are parallel with one another.

12. The cymbal assembly of claim 10 wherein during movement of the second cymbal, the first cymbal and the second cymbal remain in contact with one another.

13. The cymbal assembly of claim 10 wherein upon positioning the foot pedal to the neutral position, the first center axis of the first cymbal is collinear with the second center axis of the second cymbal.

14. A cymbal assembly comprising:

a support stand having a base adapted for positioning on a floor and an upwardly extending longitudinal member;

a foot pedal proximate the base of the support stand, the foot pedal positionable between (i) a neutral position, and (ii) an actuated position;

a displaceable member generally extending along the support stand, the displaceable member being in communication with the foot pedal, the member undergoing movement upon a change in position of the foot pedal;

a first cymbal affixed to the support stand, the first cymbal defining a first center axis and a transversely oriented first plane;

a second cymbal affixed to the displaceable member, the second cymbal defining a second center axis and a transversely oriented second plane, the second cymbal being in contact with the first cymbal;

wherein upon a change in position of the foot pedal between (i) the neutral position and (ii) the actuated position, the second cymbal undergoes movement relative to the first cymbal in a direction parallel with the second plane;

wherein upon positioning the foot pedal to the actuated position, the first center axis of the first cymbal is spaced from and parallel with the second center axis of the second cymbal.

15. The cymbal assembly of claim 10 further comprising:

at least one biasing member urging at least one of the first cymbal and the second cymbal into contact with each other.

16. The cymbal assembly of claim 10 further comprising:

an arm assembly affixed to the upwardly extending longitudinal member of the support stand, the arm assembly including an outwardly extending arm;

at least one cam affixed to the displaceable member;

wherein upon displacement of the displaceable member, contact occurs between the arm and the at least one cam.

17. A method of producing sounds comprising:

providing a cymbal assembly including (i) a support stand, (ii) a selectively positionable actuation member, (iii) a displaceable member engaged with the actuation member, (iv) a first cymbal affixed to the support stand, (v) a second cymbal affixed to the displaceable member, the second cymbal being in contact with the first cymbal, wherein upon positioning of the actuation member, the displaceable member and the second is displaced in a sliding manner relative to the first cymbal;

varying a position of the actuation member whereby the second cymbal is displaced relative to the first cymbal;

whereby sound is produced as a result of sliding contact between the first cymbal and the second cymbal.

18. The method of claim 17 further comprising:

Contacting at least one of the first cymbal and the second cymbal with an implement, whereby additional sound is produced.

19. The method of claim 17 wherein the first cymbal defines an inner cymbal face oriented along a first plane and the second cymbal defines an inner cymbal face oriented along a second plane, wherein during varying the position of the actuation member, the second cymbal is displaced within the second plane and remains parallel with the first plane of the first cymbal.

* * * * *